United States Patent [19]

Beaudet

[11] Patent Number: 4,894,687

[45] Date of Patent: Jan. 16, 1990

[54] PRESSURE TRANSFIXING OF TONER IMAGES USING SKEWED ROLLERS

[75] Inventor: Leo A. Beaudet, Milford, Mass.

[73] Assignee: Dennison Manufacturing Company, Framingham, Mass.

[21] Appl. No.: 252,089

[22] Filed: Sep. 30, 1988

Related U.S. Application Data

[63] Continuation of Ser. No. 426,466, Sep. 29, 1982, abandoned, which is a continuation-in-part of Ser. No. 180,218, Aug. 21, 1980, abandoned.

[51] Int. Cl.[4] ..... G03G 15/14

[52] U.S. Cl. ..... 355/277; 355/295

[58] Field of Search ..... 355/3 R, 3 TR, 3 FU, 355/14 FU, 277, 279, 282, 290, 295

[56] References Cited

U.S. PATENT DOCUMENTS

| | | | |
|---|---|---|---|
| 4,195,927 | 4/1980 | Fotland et al. | 355/3 TE |
| 4,200,389 | 4/1980 | Matsui et al. | 355/3 FU |
| 4,267,556 | 5/1981 | Fotland et al. | 355/3 R |
| 4,448,872 | 5/1984 | Vandervalk | 355/277 X |

FOREIGN PATENT DOCUMENTS

| | | | |
|---|---|---|---|
| 2718558 | 11/1977 | Fed. Rep. of Germany | 355/3 FU |
| 48009 | 9/1980 | Japan | 355/3 FU |

*Primary Examiner*—Fred L. Braun

*Attorney, Agent, or Firm*—Arthur B. Moore

[57] ABSTRACT

Electrostatic transfer imaging in which a latent electrostatic image is formed on a dielectric image roller, toned, and transferred to an image receptor medium. The dielectric roller contacts a transfer roller, and receptor sheets are fed between the two to receive toner images. Image transfer is effected with simultaneous fusing using high pressure between the rollers, which are skewed for enhanced efficiency of toner transfer. The rollers are skewed, preferably at an angle in the range 0.5 degree to 1.5 degree. Receptor sheets adhere to the surface of the transfer roller in preference to that of the image roller, thereby creating a relative motion between the dielectric surface and receptor sheet. This surface motion differential considerably improves the efficiency of toner transfer from the image roller to the receptor sheet, thereby reducing residual toner on the image roller.

16 Claims, 4 Drawing Sheets

PRESSURE TRANSFIXING OF TONER IMAGES USING SKEWED ROLLERS

This is a continuation of Ser. No. 426,466 filed Sept. 29, 1982, now abandoned, which is a continuation-in-part of Ser. No. 180,218 filed Aug. 21, 1980, now abandoned.

BACKGROUND OF THE INVENTION

The present invention relates to electrostatic imaging apparatus, and more particularly to apparatus for transferring and fusing toned electrostatic images to plain paper and the like.

Electrostatic imaging processes initially require the formation of a latent electrostatic image, typically by electrographic or electrophotographic means, on a dielectric member. The latent electrostatic image is subsequently toned, and the toned image may be transferred to a further member. In the usual case, the toned image is transferred to plain paper. The transferred image is usually subsequently fused or fixed to the receptor medium, to provide enhanced durability and permanence.

Various toner image transfer methods are known in the prior art. The transfer may be accomplished electrostatically, by means of a charge of opposite polarity to the charge on the toner particles, the former charge being used to draw the toner particles off the dielectric member and onto the image receptor. Patent illustrative of this transfer method include U.S. Pat. Nos. 2,944,147; 3,023,731; and 3,715,762. Alternatively, the image receptor medium may be passed between the tonerbearing member and a transfer member, and the toner image transferred by means of pressure at the point of contact. Patents illustrative of this method include U.S. Pat. Nos. 3,701,966; 3,907,560; and 3,937,571. Usually, the toner image is fused to the image receptor subsequently to transfer of the image, at a further process station. Postfusing may be accomplished by pressure, as in U.S. Pat. No. 3,874,894, or by exposure of the toner particles to heat, as in U.S. Pat. No. 3,023,731 and Re. No. 28,693.

It is possible, however, to accomplish transfer and fusing of the image simultaneously, as shown for example in the patents cited above as illustrative of pressure transfer. This may be accomplished by a heated roller, as in Re. No. 28,693, or simply by means of high pressure between the image-bearing dielectric member and a transfer member, between which the image receptor passes. Apparatus utilizing high pressure for simultaneous transfer/fusing (termed "transfixing" by the inventor) is disclosed in U.S. Pat. Nos. 4,195,927 and 4,267,556; both are commonly assigned with the present invention, which is of the nature of an improvement thereto.

A problem which is typically encountered in transferring a toner image solely by means of pressure is the existence of a residual toner image on the dielectric member after image transfer, due to inefficiencies in toner transfer. These residual toner particles require scraper blades or other removal means, and can eventually accumulate at the various process stations associated with the dielectric member, including the apparatus for forming the latent electrostatic image. These toner accumulations decrease the reliability of the apparatus, necessitating service at intervals. Furthermore, such inefficiencies in toner transfer may lead to mottling of the images formed on the image receptor sheets.

French Patent No. 2,075,798 discloses apparatus for transferring a toner image onto an image receptor, involving an imaging roller and a pressure roller arranged to be normally in contact under high pressure. Various embodiments are disclosed for achieving a slippage between the surface of the imaging roller (from which the toner image is transferred) and the image receptor. These include covering the pressure roller with an elastic material, and driving the rollers to achieve a peripheral speed differential. The apparatus is said to achieve lower transfer pressure requirements and provide higher toner transfer efficiency. There is no suggestion of skewing the rollers to achieve these advantages, however.

U.S. Pat. Nos. 3,990,391; 4,188,109; 4,192,229; and 4,200,389 are representative of the prior art of pressure fusing apparatus employing skewed rollers. The main advantage and primary objective of skewing such pressure fusing rollers is to provide a uniform pressure distribution along the nip. This is said to reduce the loading requirements, while providing improved fusing quality across the toner-bearing sheet. These patents are not concerned with toner transfixing, and in particular with the property of toner transfer efficiency. There is no concern with providing a surface motion differential at the roller-sheet interface, and hence with achieving sufficient angular skew for this purpose. In fact, U.S. Pat. No. 3,990,391 at col. 2, lines 1–8, teaches the desirability of minimizing angular skew in order to reduce the wrinkling of the toner-bearing sheet.

Accordingly, it is an object of the invention to provide improved electrostatic imaging apparatus for pressure transfer of a toner image from a dielectric surface to a receptor sheet. A related object of the invention is to provide a transfer method which effects simultaneous fusing of the toner image.

It is a paramount object of the invention that the simultaneous pressure transfer/fusing be characterized by a high efficiency of toner transfer.

It is a further object of the invention to minimize the amount of residual toner on the dielectric image member after transfer/fusing. Related objects are increased reliability of electrostatic imaging apparatus, and decreased service requirements.

Yet another object of the invention is the enhancement of image texture. A related object is the avoidance of mottling of the transferred toner image.

A further, related object of the invention is to provide apparatus which allows the creation of high quality toned images at high speeds.

SUMMARY OF THE INVENTION

In furthering the above and additional objects, the invention provides for pressure transfixing of toner images by passing an image receptor sheet between two rollers under high pressure, these rollers being disposed in a non-parallel axial orientation, i.e. "skewed". The toner image is transferred from a first of these rollers, termed an "image" roller, to the receptor sheet. The receptor sheet tends to move with the surface of the other roller, which is termed a "transfer" roller. These skewed rollers achieve toner transfixing with a dramatic improvement in toner transfer efficiency as compared with parallel rollers.

In a preferred embodiment of the invention, the image roller has a hard, smooth dielectric surface. Best results obtained where the surface has a smoothness in excess of 20 microinch RMS, and a high modulus of elasticity in compression on the order of $10^7$ PSI. The transfer roller preferably includes a relatively compliant surface layer, to which the image receptor sheet will tend to adhere in preference to that of the image roller. Advantageously, the transfer roller surface comprises a stress-absorbing engineering thermoplastic or thermoset material, having a modulus of elasticity in compression on the order of 100,000–700,000 PSI.

One aspect of the invention concerns the improvement of toner transfer efficiency with transfixing which is characteristic of the invention. As a related advantage, residual toner on the imaging roller after transfer is commensurately reduced. The residual toner remaining on the image roller is typically reduced to an amount of one percent of that normally found. Skewing of the rollers will improve pressure distribution thereby reducing "bowing" of the rollers. However, toner transfer efficiency continues to improve even at higher skew angles than those preferred for optimal load distribution.

Another aspect of the invention concerns the geometric relationship at the nip between the image receptor surface and that of the image roller. The tendency of the receptor sheet to follow the transfer roller causes the sheet to slip against the image roller's surface. This slip consists of a sidewise motion of the receptor sheet along the nip relative to the surface of the image roller. The motion can be quantified according to the ratio of sidewise travel to the width of the nip [i.e. the extent of the nip measured in the direction of travel of the receptor sheet]. This ratio preferably falls between 0.5 and 2 percent, most preferably between 0.5 and 1.0 percent.

Yet another aspect of the invention relates to the degree of skew measured in terms of angle between the roller axes. It is preferable to provide sufficient offset to achieve the desired toner transfer efficiency, while avoiding undue slanting of the image which results at high degrees of skew. Advantageously, the rollers are skewed by between 0.5 and 1.5 degrees, more preferably between 0.5 and 1 degree.

In the preferred embodiment, the toner image is formed on a dielectric image roller by developing a previously formed latent electrostatic image.

The skewed transfixing apparatus of the invention also achieves improved fusing quality. In the preferred embodiment, this effect is largely attributable to roller materials.

BRIEF DESCRIPTION OF THE DRAWINGS

The foregoing and related aspects of the invention are illustrated with reference to the detailed description which follows in conjunction with the drawings in which.

DETAILED DESCRIPTION

Figure 1:
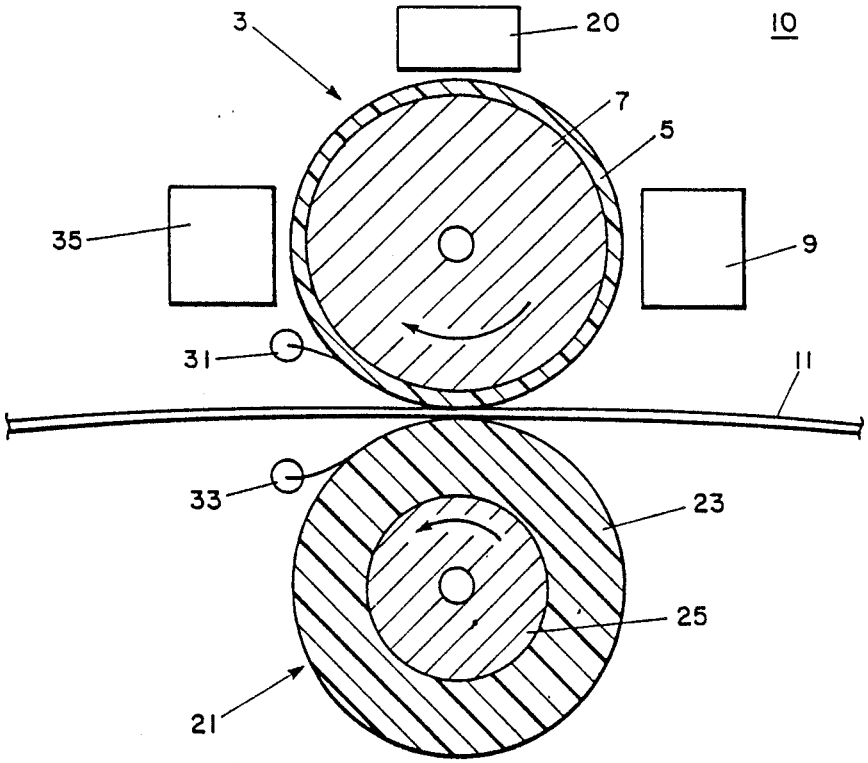
FIG. 1 is a schematic end view of apparatus in accordance with a preferred embodiment of the invention.

Reference should now be had to FIGS. 1–4 for a detailed description of the electrostatic transfer imaging apparatus of the invention. As seen in FIG. 1, the imaging apparatus 10 includes an image roller 3 on which a latent electrostatic image is formed and thereafter toned, and a transfer roller 21 which is disposed in rolling contact with the image roller. An image receptor 11, typically a paper sheet or web, is fed between the two rollers in order to receive the toner image from the roller 3.

A latent electrostatic image is formed on a dielectric surface layer 5 of the image roller 3 at process station 20. The image may be formed by electrographic means, as disclosed, for example, in U.S. Pat. No. 4,267,556. Alternatively, the electrostatic latent image may be formed by means of a TESI transfer from a photoconductor as disclosed in U.S. Pat. No. 4,195,927.

The latent electrostatic image is rendered visible by toning at station 9. While any conventional electrostatic toner may be used, the preferred toner is of the single component conducting magnetic type described by J.C. Wilson, U.S. Pat. No. 2,846,333, issued Aug. 5, 1958. This toner has the advantage of simplicity and cleanliness.

The toner image is simultaneously transferred and fused onto image receptor 11 by high pressure applied between rollers 3 and 21. The image is transferred and fused at room temperature, without electrostatic aid. The details of this transfixing process are discussed below.

Scraper blades 31 and 33 clean any residual paper or toner dust from the rollers 3 and 21. Since substantially all of the toned image is transferred to the receptor 11, the image scraper blades may not be required, but are desirable in promoting reliable operation over an extended period. The electrostatic transfer imaging apparatus may also include an eraser unit 35 for eliminating any latent electrostatic image. The action of toning and transferring a toned latent image to an image receptor reduces the magnitude of the electrostatic image, typically from several hundred volts to several tens of volts. In some cases, if the toning threshold is too low, the presence of a residual latent image will result in ghost images on the copy sheet, which are eliminated by the eraser unit 35.

In the preferred embodiment of the invention, the dielectric surface layer 5 on the roller 3 has sufficiently high resistance to support a latent electrostatic image during the period between latent image formation and toning. Consequently, the resistivity of the layer 5 should be in excess of $10^{12}$ ohm-centimeters. The preferred thickness of layer 5 is between one and two mils. In addition, the surface of the layer 5 should be highly resistant to abrasion and relatively smooth, with a finish that is preferably better than 20 microinch RMS. The smoothness of the surface of the dielectric layer 5 contributes to the efficiency of toner transfer to the image receptor 11 by enhancing the release properties of this surface. The dielectric coated roller 3 additionally has a high modulus of elasticity in compression, typically on the order of $10^7$ PSI, to minimize roller distortion caused by high pressures in the transfer nip.

A number of organic and inorganic dielectric materials are suitable for the layer 5. Glass enamel, for example, may be deposited and fused to the surface of a steel or aluminum cylinder. Flame or plasma sprayed high density aluminum oxide may also be employed in place of glass enamel. Plastic materials, such as polyimides, nylons, and other tough thermoplastic or thermoset resins, are also suitable. However, the preferred dielectric coating is impregnated, anodized aluminum oxide as described in copending patent application Ser. No. 072,524 filed Sept. 4, 1979, now abandoned, which is a continuation-in-part of patent application Ser. No. 822,865, filed Aug. 8, 1977.

In an alternative embodiment, the imaging roller 3 includes a photoconductive surface layer 5 over a conducting substrate 7. With reference to FIG. 1, the imaging apparatus at station 20 in this embodiment includes any suitable apparatus known in the art for depositing a uniform charge on the surface of layer 5, and for exposing this surface to a pattern of light and shadow whereby the charge is selectively dissipated to form a latent electrostatic image. As in the case of the dielectric layer 5 of the preferred embodiment, photoconductor layer 5 is advantageously smooth and abrasion resistant, with a high modulus of elasticity. See Example 4.

The pressure or transfer roller 21 consists of a metallic core 25 having an outer covering 23 of enginnering thermoplastic or thermoset material. The material of covering 23 of roller 21 typically has a modulus of elasticity in compression on the order of 100,000–700,000 PSI. The image receptor 11 will tend to move with the covering 23 in preference to the dielectric layer 5 because of the differences in the surfaces, notably in smoothness and modulus of elasticity. Consequently, the image receptor 11 will tend to move with the pressure roller when there is a relative motion between the roller surfaces. Although in practice image receptor 11 may slip slightly against the surface of covering 23 of transfer roller 21, this effect is minor when compared with the pronounced slip relative to the dielectric layer 5. Another function of the covering 23 is to absorb any high stresses introduced into the nip in the case of a paper jam or wrinkle. By absorbing stress in the plastic covering 23, the dielectric coated roller 3 will not be damaged during accidental paper wrinkles or jams. Covering 23 is typically of nylon or polyester having a radial thickness in the range of $\frac{1}{8}$ to $\frac{1}{2}$ an inch.

The pressure required for good fusing to plain paper is governed by such factors as, for example, roller diameter, the toner employed, and the presence of any coating on the surface of the paper. It has been discovered, in addition, that a skewing of rollers 3 and 21 will decrease the transfer pressure requirements. See Example 2. Typical pressures range from 100 to 700 pounds per linear inch of contact.

Figure 2:
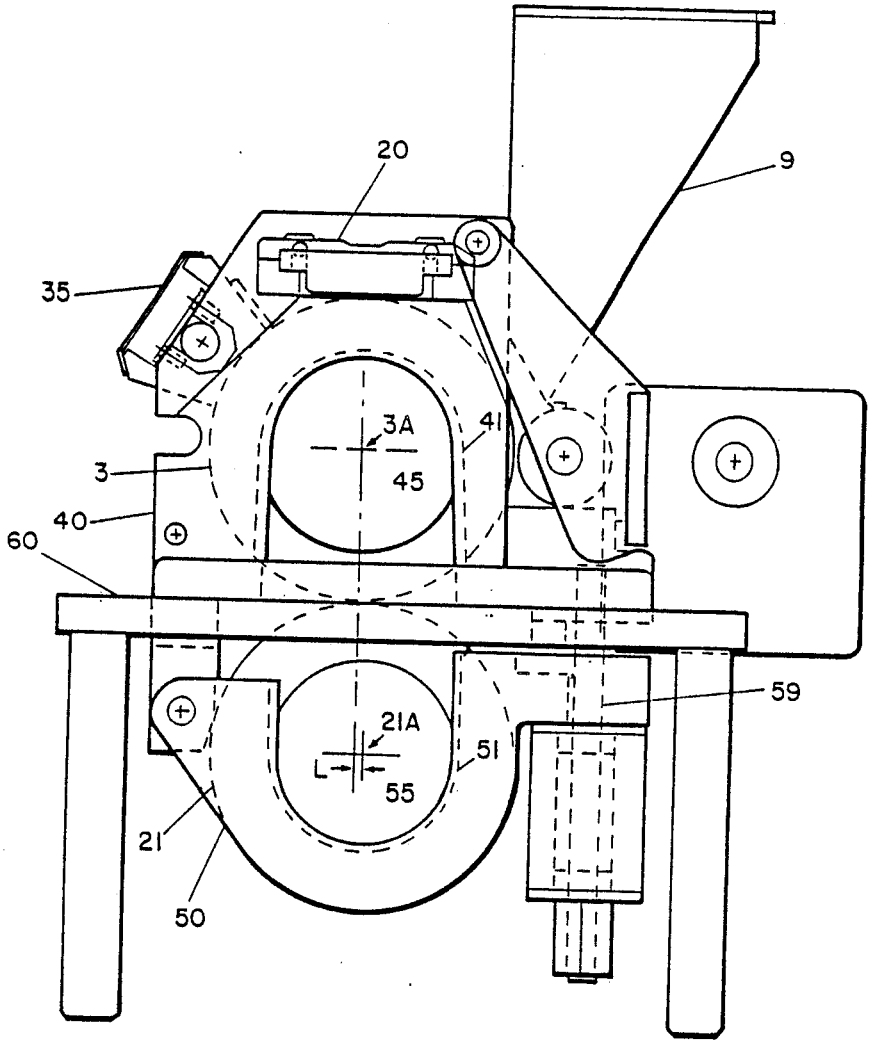
FIG. 2 is an end view of apparatus in accordance with the embodiment of FIG. 1.

With reference to FIG. 2, imaging apparatus 10 is seen from one end, and shows the rollers 3 and 21 mounted in pairs of side frames 40 and 50 (one of each being visible in this figure). The side frames 40 and 50 house respective pairs of bearings 45 and 55, which are fitted to rollers 3 and 21 in order to allow the rotation of the rollers while constraining their horizontal and vertical movement. These are of the type known as "self-aligning" and are located within lips 41 and 51 on the respective side frames, and against corresponding shoulders (not shown) on the respective rollers. Side frames 50 are pivotally slung at one side to superstructure 60, and are carried at their other ends in spring-loaded supports 59 in order to provide a prescribed pressure between the rollers 3 and 21 at the nip formed by these rollers. Roller 3 is driven at a desired rotation velocity by means not shown, while roller 21 is frictionally driven due to the contact of the rollers at the nip.

The mounting illustrated in FIG. 2 provides a specified "skew", or deviation of the axes of rollers 3 and 21 from a parallel orientation. Rollers 3 and 21 may be adjustable around a pivot point at one end, moving the other end relative to its position with the rollers parallel while maintaining pressure between the rollers. Alternatively, the rollers may pivot around a central point of contact, by adjusting the offset of one of the rolls about the axis of the other, this adjustment being equal at both end. This latter, "end-to-end" skew will be assumed hereinafter for illustrative purposes.

As shown in FIG. 2, axle 21A is disposed in end-to-end skew, which may be measured as an offset L in the plane of side frame 50. A more significant measure of skew, however, is the angle between the projected axes of rollers 3 and 21 as measured in the horizontal plane, or plane of the image receptor 11. An illustrative value of skew to effect the objects of the invention is 0.10 inch, measured at the center of roller bearings 45 and 55, which are separated by a distance of 10.375 inch for 9 inch long rollers. This represents an angle of roughly 1.1°.

Figure 3A:
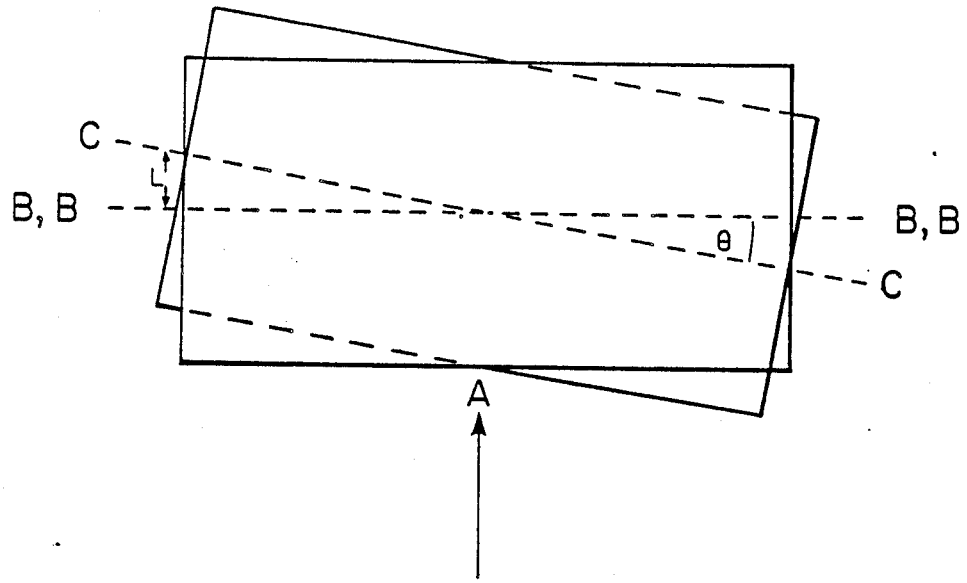
FIG. 3A is a diagrammatic representation of skewed image and transfer rollers used in the apparatus and viewed from above.

FIG. 3A schematically illustrates skewed rollers 3 (with axis B—B) and 21 (with axis C—C) as seen from above. Roller 21 is skewed at the bearing mounts by horizontal offset L from the vertically projected axis B′–B′ of roller 3. Skewing roller 21 rather than roller 3 avoids the need to adjust the various peripheral devices associated with the image roller. This skew corresponds to an angle $\theta$ between axes B—B and C—C.

Figure 3B:
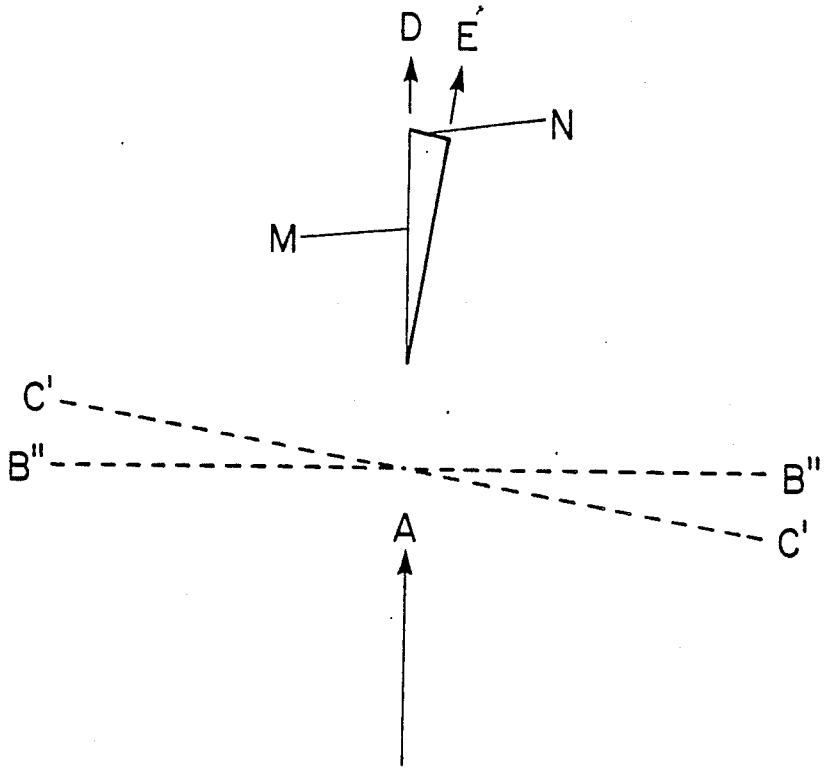
FIG. 3B is a geometric model of part of the area of contact between the image and transfer rollers.
Figure 4:
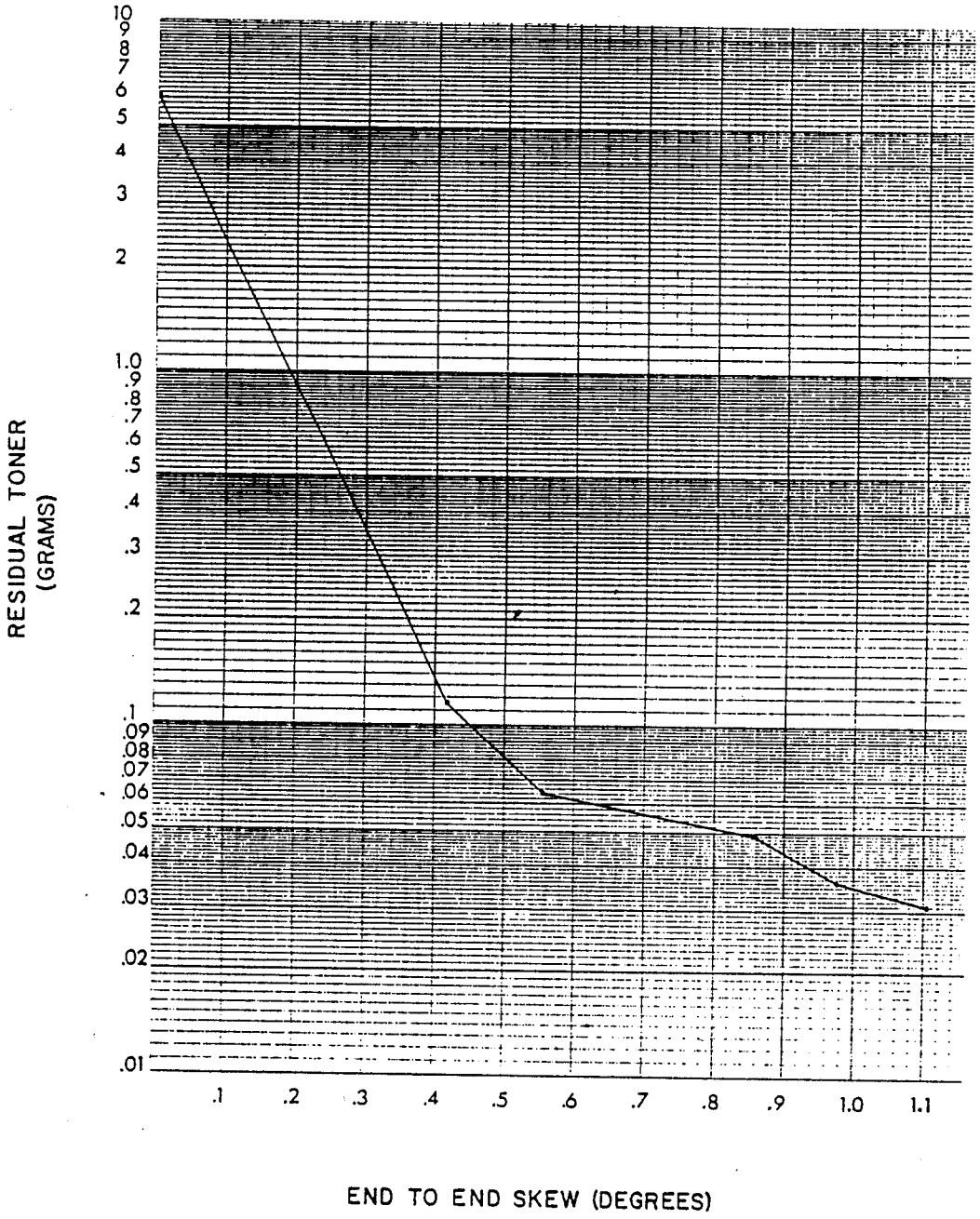
FIG. 4 is a plot of skew against residual toner for the apparatus of Example 3.

FIG. 3B is a geometric representation of the surface of contact of the rollers at the nip, showing the direction of paper feed before and after engagement by the rollers. As a sheet of paper 30 enters the nip, illustratively in a direction A perpendicular to the axis of the image roller 3, it is subjected to divergent forces in direction D (perpendicular to the projected axis B″—B″ of roller 3) and E (perpendicular to the projected axis C′—C′ of roller 21). Because of the relatively high smoothness and modulus of elasticity in compression of the surface 5 of roller 3, the paper 30 will tend to adhere to the lower roll, and therefore to travel in direction E. This results in a surface speed differential or "slip" between the surfaces of paper 30 and roller 3.

Due to the compression of the lower roller 21 at the nip, paper 30 will contact both roller surfaces over a finite distance M in direction D. The width of the contact area, M, can be calculated using a formula found in *Formulas For Stress and Strain* (4th edition) by Ronald J. Roark, published by McGraw-Hill Book Company. The formula for the case of two cylinders in contact under pressure with parallel axes can be found on page 320 of the Roark text, table XIV, section 5. The transaxial width in inches of the contact area of the two cylinders is given by:

$$M = 1.6\sqrt{P_1 \frac{D_1 D_2}{D_1 + D_2}\left[\frac{1 - \nu_1^2}{E_1} + \frac{1 - V_2^2}{E_2}\right]}$$

where:

P represents the cylinder loading in pounds per linear inch;

$D_1$ and $D_2$ represent the diameters of the cylinders in inches;

$V_1$ and $V_2$ represent Poisson's ratio in compression for the materials of the cylinders; and $E_1$ and $E_2$ represent the modulus of elasticity in compression for the materials of the cylinders, in pounds per square inch. With reference to the resultant triangle in FIG. 3B, the surface of paper 30 will undergo a proportional side travel N with respect to the surface of roller 3, the factor of proportionality being twice the ratio of roller offset to the length of the rollers, for end-to-end skew. Equivalently, $N = M \tan \theta$. In practice, the amount of slip, which is measurable by a vernier analysis of a printed test image will usually be less than would be expected from theoretical calculation. In general, slip increases with a greater quantity of toner in the nip, in that the toner particles act as a lubricant. Applicants have determined that a slip of between 0.5 and 2 percent, and more preferably between 0.5 and 1.0 percent, provides excellent image quality with reduced residual toner.

The motion of the image receptor sheet relative to the image roller 3 results in a slanting of the image, an effect which becomes more noticeable at higher degrees of skew. If the sheet is fed into the nip perpendicularly to the image roller axis, a slanting of the vertical margins (i.e. those margins corresponding to the ends of the rollers) will occur. On the other hand, an infeed direction perpendicular to the transfer roller axis will cause a slanting of the horizontal margins. This imaging effect can be alleviated by feeding the paper in an intermediate direction, thereby avoiding a pronounced slanting along either axis in the image. It is generally preferable to skew the rollers by no more than 1.5° to assure reasonable orthogonality of the transferred image.

The skewing of rollers 3 and 21 in the above-described manner results in a surprising improvement in the efficiency of toner transfer from dielectric surface 5 to image receptor 30. Applicant theorizes that this improvement is primarily attributable to the slip effect discussed above, rather than the concurrent effect of altered pressure distribution along the nip. This is borne out by the continued improvement in transfer efficiency encountered at skew angles above the value needed for optimal peak pressure uniformity along the transfer nip -- cf. Examples 3, 5 below. This efficiency may be expressed in percentage terms as the ratio of the weight of toner transferred to that present on the dielectric roller before transfer. This bears a complementary relationship to the weight of residual toner on the dielectric roller after transfer. The increase in transfer efficiency, which is the most notable advantage of the invention, minimizes the service problems attributable to the accumulation of residual toner at the peripheral devices associated with the image roller 3, including scraper blades 31 and 33, erase head 35, and image generator 20. This effect depends on the choice of surface material 5 and toner. Preferably, the apparatus of FIG. 1 is skewed by an angle of at least 0.5° to achieve an advantageous improvement in transfer efficiency.

The invention is further illustrated with reference to the following non-limiting examples.

EXAMPLE 1

Apparatus of the type illustrated in FIGS. 1 and 2 incorporated a 9 inch long, 4 inch outer diameter roller 3 having a dielectric surface layer 5 of anodically formed porous aluminum oxide, which had been dehydrated and impregnated with an organic resin and then surface polished, in accordance with the method of Ser. No. 072,524 filed Sept. 4, 1979, now abandoned. The dielectric surface of roller 3 was polished to obtain a finish of better than 10 microinch RMS. The pressure cylinder 21 included a 9 inch long steel core with an outer diameter of 3.125 inches over which was pressed a 0.375 inch thick sleeve of polyvinylchloride. The rollers were pressed together at 350 pounds of pressure per linear inch of nip.

A latent electrostatic image was formed on the dielectric surface of roller 3 by means of an ion generator of the type disclosed in U.S. Pat. No. 4,160,257. The various voltages to the ion generator 20 were maintained at constant values. The tests were conducted under the same ambient conditions throughout.

The toner employed was Hunt 1186 of the Phillip A. Hunt Chemical Corporation, Palisades Park, NJ. The single component latent image toning apparatus was essentially identical to that employed in the Develop KG Dr. Eisbein & Co., (Stuttgart) No. 444 copier.

The toner was transferred onto Finch white bond paper, #60 vellum of Finch, Pruyn and Co, Glens Falls, NY. This paper was fed into the nip between the dielectric and pressure rollers at a constant speed throughout the tests.

Using the above specifications, the apparatus was operated at 0° skew, .55° skew, and 1.1° skew, where the skew was measured at the bearing retainers of the 9 inch long pressure roll. The results shown in Table A were obtained by collecting the residual toner and comparing its weight to the known weight of toner before transfer. No after transfer printing was present on the upper cylinder during the tests with 0.55° and 1.1° skew. However, transfer was so poor during the test without skew that printing was plainly visible on the upper cylinder after transfer.

Dry rub tests were performed according to the Sutherland dry rub test by abrading the paper for ten strokes with a 918 gram weighted pad followed by wiping with absorbent tissue. The various samples exhibited moderate smearing uniformly across the sheet, except for the unskewed sample which showed extremely poor image quality.

EXAMPLE 2

The apparatus of Example 1 was employed with Desoto toner 2494-5 of Desoto Inc, Des Plaines, Ill. The toner was transferred onto coated OCR Imagetroll paper, manufactured by S.D. Warren. The rollers were pressed together without skew at 420 pounds per linear inch, resulting in a transfer efficiency of 92.6 percent, measured by comparing the weight of toner before image transfer to the weight of residual toner. The rollers were then pressed together at 1.1° skew, with a pressure of 200 pounds per linear inch, and all other parameters unchanged, resulting in a transfer efficiency of 99.95 percent.

Dry rub tests were performed as in Example 1, and the results graded on a subjective scale of 1 (best) to 10 (worst). The unskewed apparatus produced a fusing quality of 5, while the skewed apparatus produced a fusing quality of 3.

EXAMPLE 3

The apparatus of Example 1 was employed with the following modifications. The pressure cylinder 21 comprised a 9 inch long steel mandrel with a 1.945 inch outer diameter, over which was pressed a 9 inch long Celcon sleeve with a 3.50 inch outer diameter. (Celcon is a trademark of Celanese Chemical Co., Chatham, N.J., for thermoplastic linear acetal resins). The two rollers were pressed together at 200 pounds of nip pressure per linear inch of nip.

The toner employed was Coates RP0357 of the Coates Bros. and Co., Ltd, Dallas, Penn. The toner was transferred onto Finch white bond paper, #60 vellum.

Using the above specifications, the apparatus was operated with end-to-end skew, varied over a range of angles from 0.O° to 1.1°. The apparatus was operated using a constant weight of toner prior to transfer, and the residual toner present on dielectric roller 3 was collected and weighed. The results are shown in Table B, and are graphed in FIG. 4. In the case of the test using no skew, the residual toner was visible as printing remaining on the upper roller.

These tests showed a dramatic improvement in the efficiency of toner transfer when the skew was increased from 0.O° to .42°; this resulted in a decrease in the weight of residual toner by a factor of 53. Increases in skew from .42° to .85° and from .55° to 1.1° further reduced the weight of residual toner by factors of somewhat better than 2. The collected toner was distributed fairly uniformly along the nip at the various skew angles, despite variations in pressure distribution. Optimal uniformity of peak pressure along the nip, as calculated, was obtained with a skew of approximately 0.9°. Nevertheless, toner transfer efficiency continued to improve at higher skew angles.

Fusing quality was tested using a dry rub test performed and graded as in Example 2. The results are given in Table B.

TABLE A

TONER TRANSFER EFFICIENCY, EXAMPLE 1

| END-TO-END SKEW | PERCENTAGE OF TONER NOT TRANSFERRED |
|---|---|
| none | 12.6 |
| .55° | .1 |
| 1.1° | .1 |

TABLE B

TONER TRANSFER EFFICIENCY AND FUSING QUALITY, EXAMPLE 3

| END-TO-END SKEW | RESIDUAL TONER (GRAMS) | DRY RUB RESULTS |
|---|---|---|
| 0° | 6.034 | 10 |
| .42° | 0.114 | 7 |
| .55° | 0.066 | 5 |
| .85° | 0.050 | 3 |
| .97° | 0.036 | 2 |
| 1.1° | 0.031 | 1 |

EXAMPLE 4

The apparatus of Example 1 was employed with the modification that the imaging roller 3 comprised a photoconductive roller. An aluminum sleeve was fabricated of 6061 aluminum tubing with a ⅛" wall and 4" outer diameter. The sleeve 7 was spray-coated with a binder layer photoconductor 5 consisting of photoconductor grade Sylvania PC-100 cadmium sulfide pigment of Sylvania Coml. Electronics Corp., dispersed in a melamine-acrylic resin, diluted with methyl ethyl ketone to a viscosity suitable for spraying. The resin was cross-linked by firing at 600° for three hours.

A photoconductor charging corona and optical exposing system were essentially identical to those employed in the Develop KG Dr. Eisbein & Co. (Stuttgart) No. 444 Copier.

The toner transfer efficiency and fusing quality underwent improvements comparable to those of Example 1 for increasing skew angles of 0.0°, 0.55°, and 1.1°.

EXAMPLE 5

Apparatus of the type illustrated in FIGS. 1 and 2 included a 5 inch long, 4 inch outer diameter roller 3 having a dielectric surface layer 5 of anodically formed porous aluminum oxide, which had been dehydrated and impregnated with an organic resin and the surface polished in accordance with the method of U.S. patent application 072,524 filed Sept, 4, 1979, now abandoned. The dielectric surface was polished to obtain a finish of better than 10 microinch RMS. The pressure roller 21 included a 5 inch long steel core with an outer diameter of 3.125 inches over which was pressed a 0.375 inch thick sleeve of Delrin acetal resin (Delrin is a registered trademark of E.I. DuPont DeNemours & Co., Wilmington, Del.). The rollers were pressed together at 200 pounds per linear inch of nip.

A latent electrostatic image was formed and developed as in Example 2. Using the above specifications, the apparatus was operated at a 0.098 inch offset end for end, or angle of 1.28°. This was more than five times the value calculated for uniform peak pressure. As observed, pressure along the nip was highly non-uniform, and highest in the center.

No measurable residual toner was collected, indicating virtually perfect transfer efficiency. Excellent fusing quality and image density were obtained.

EXAMPLE 6

The apparatus of Example 5 was operated, using the Coates RP035 toner of Example 3. Essentially identical toner transfer and fusing results were obtained.

While various aspects of the invention have been set forth by the drawings and the specification, it is to be understood that the foregoing detailed description is for illustration only and that various changes in parts, as well as the substitution of equivalent constituents for those shown and described, may be made without departing from the spirit and scope of the invention as set forth in the appended claims.

I claim:

1. Apparatus for forming an image on a receptor sheet, comprising:

an image roller with a hard, smooth surface with a finish that is better than 20 microinch RMS;

means for forming a toner image on said image roller; and a transfer roller in rolling contact under high pressure with the image roller, including a surface material selected from the class consisting of engineering thermoplastic and engineering thermoset materials, said transfer roller having a non-parallel axial orientation and an angle of skew of between 0.5 and 1.5 degrees with respect to said image roller.

wherein the toner image is transferred from the image roller and simultaneously fused to a receptor sheet which is fed through a nip between said image roller and said transfer roller, and wherein said receptor sheet adheres to the surface of said transfer roller at the nip in preference to the surface of the image roller, causing a surface motion differential between the receptor sheet and the image roller at said nip.

2. Apparatus as defined in claim 1 wherein the surface of said image roller has excellent release characteristics for said toner.

3. Apparatus as defined in claim 1 in which the image roller has a smoothness in excess of 10 microinch RMS.

4. Apparatus as defined in claim 1 wherein said receptor sheet is fed toward the area of contact between said image roller and transfer roller in a direction perpendicular to the axis of said imaging roller.

5. Apparatus as defined in claim 1 wherein the toner transfer efficiency is greater than 99 percent.

6. Apparatus as defined in claim 1 wherein the image roller comprises a dielectric surface layer over a conductive core.

7. Apparatus as defined in claim 1 wherein the rollers are pressed together with a pressure in the range from 100 to 700 pounds per linear inch.

8. Apparatus as defined in claim 1 in which said imaging roller comprises a dielectric surface layer over a conductive sublayer.

9. Apparatus as defined in claim 8 wherein the dielectric surface layer of said image roller is comprised of hardcoat anodized aluminum impregnated with an insulating material.

10. Apparatus for forming an image on a receptor sheet, comprising:

an image roller, means for forming a toner image on said image roller; and a transfer roller in rolling contact under high pressure with said imaging roller, having a non-parallel axial orientation with an angle of skew between 0.5 and 1.5 degrees with respect to said image roller, wherein the toner image is transferred with a transfer efficiency of at least 98 percent from said image roller onto a receptor sheet which is fed through a nip between said image roller and said transfer roller, and said toner image is simultaneously fused to said receptor sheet, and wherein said receptor sheet adheres to the surface of said transfer roller at the nip in preference to the surface of the image roller, causing a surface motion differential between the receptor sheet and the image roller at said nip.

11. Apparatus as defined in claim 10 wherein the image roller has a dielectric surface layer comprised of hardcoat anodized aluminum impregnated with an insulating material.

12. Apparatus as defined in claim 10 wherein the transfer roller includes a surface selected from the class consisting of engineering thermoplastic and thermoset materials.

13. Apparatus as defined in claim 10 wherein the image roller has a smoothness in excess of 20 microinch RMS.

14. Apparatus as defined in claim 10 wherein the rollers are pressed together with a pressure in the range from 100 to 700 pounds per lineal inch.

15. Apparatus as defined in claim 10 wherein the image roller comprises a dielectric surface layer over a conductive core.

16. Apparatus for forming an image on a receptor sheet comprising:

an image roller, means for forming a toner image on said image roller; and a transfer roller in rolling contact under high pressure with said imaging roller having a non-parallel axial orientation with an angle of skew between 0.5 and 1.5 degrees with respect to said image roller, wherein the toner image is transferred with a transfer efficiency of at least 98 percent from said image roller onto a plain paper receptor sheet which is fed through a nip between said image roller and said transfer roller, and said toner image is simultaneously fused to said receptor sheet, and wherein said receptor sheet adheres to the surface of said transfer roller at the nip in preference to the surface of the image roller, causing a surface motion differential between the receptor sheet and the image roller at said nip.

* * * * *